US008211360B2

(12) United States Patent
Matsui et al.

(10) Patent No.: US 8,211,360 B2
(45) **Date of Patent: *Jul. 3, 2012**

(54) NICKEL-BASED HEAT RESISTANT ALLOY FOR GAS TURBINE COMBUSTOR

(75) Inventors: Takanori Matsui, Saitama (JP); Komei Kato, Saitama (JP); Takuya Murai, Kounosu (JP); Yoshitaka Uemura, Takasago (JP); Daisuke Yoshida, Takasago (JP); Ikuo Okada, Takasago (JP)

(73) Assignees: Mitsubishi Materials Corporation, Tokyo (JP); Mitsubishi Heavy Industries, Ltd, Tokyo (JP)

( * ) Notice: Subject to any disclaimer, the term of this patent is extended or adjusted under 35 U.S.C. 154(b) by 721 days.

This patent is subject to a terminal disclaimer.

(21) Appl. No.: 12/297,213

(22) PCT Filed: Apr. 13, 2007

(86) PCT No.: PCT/JP2007/058196

§ 371 (c)(1),
(2), (4) Date: Oct. 14, 2008

(87) PCT Pub. No.: WO2007/119832

PCT Pub. Date: Oct. 25, 2007

(65) Prior Publication Data

US 2009/0136382 A1 May 28, 2009

(30) Foreign Application Priority Data

Apr. 14, 2006 (JP) ..... 2006-111749

(51) Int. Cl.
*C22C 19/05* (2006.01)
*C22F 1/10* (2006.01)

(52) U.S. Cl. ..... 420/449; 148/677

(58) Field of Classification Search ..... 420/449; 148/675, 677

See application file for complete search history.

(56) References Cited

U.S. PATENT DOCUMENTS

| | | | | |
|---|---|---|---|---|
| 3,655,458 | A * | 4/1972 | Reichman | 419/15 |
| 4,093,454 | A * | 6/1978 | Saito et al. | 75/236 |
| 4,877,461 | A | 10/1989 | Smith et al. | |
| 2005/0016178 | A1 * | 1/2005 | Wasif et al. | 60/752 |
| 2006/0051234 | A1 | 3/2006 | Pike, Jr. | |

FOREIGN PATENT DOCUMENTS

| | | | |
|---|---|---|---|
| JP | 61-79742 | A | 4/1986 |
| JP | 02-107736 | A | 4/1990 |
| JP | 2004-256840 | A | 9/2004 |
| JP | 2006-70360 | A | 3/2006 |

OTHER PUBLICATIONS

ASM International, Materials Park, Ohio, ASM Specialty Handbook:Nickel, Cobalt, and Their Alloys, "Metallography, Microstructures, and Phase Diagrams of Nickel and Nickel Alloys", Dec. 2000, pp. 302-304.*

* cited by examiner

*Primary Examiner* — Jessee R. Roe
(74) *Attorney, Agent, or Firm* — Leason Ellis LLP

(57) ABSTRACT

A Ni-based heat resistant alloy for a gas turbine combustor, comprising a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%; Fe: 7.0% or less, B: 0.001 to 0.020%, C: 0.03 to 0.15%, and a balance consisting of Ni and unavoidable impurities, wherein a content of S and P contained in the unavoidable impurities is controlled to be, in mass %, S: 0.015% or less, and P: 0.015% or less, wherein the alloy has a texture in which $M_6C$ type carbide and MC type carbide are uniformly dispersed in γ phase matrix.

28 Claims, 4 Drawing Sheets

NICKEL-BASED HEAT RESISTANT ALLOY FOR GAS TURBINE COMBUSTOR

CROSS-REFERENCE TO PRIOR APPLICATION

This is the U.S. National Phase Application under 35 U.S.C. §371 of International Patent Application No. PCT/JP2007/058196 filed Apr. 13, 2007, which claims the benefit of Japanese Patent Application No. 2006-111749 filed Apr. 14, 2006, both of them are incorporated by reference herein. The International Application was published in Japanese on Oct. 25, 2007 as WO2007/119832 a1 under pct article 21(2).

FIELD OF THE INVENTION

The present invention relates to a Ni-based heat-resistant alloy used in production of gas-turbine combustors. Specifically, Ni-based heat-resistant alloy of the present invention relates to a member used in production of liners of gas-turbine combustors, or a member used in production of transition pieces. The present invention further relates to a liner or a transition piece that comprises the same Ni-based heat-resistant alloy.

Priority is claimed on Japanese patent application, No. 2006-111749, filed on Apr. 14, 2006, the content of which is incorporated herein with reference.

BACKGROUND ART

In general, a combustor of a gas-turbine is placed in the vicinity of an outer periphery of a backside of a compressor. The role of the combustor includes, spraying fuel to the air discharged from the compressor, combusting the fuel to produce high-temperature and high-pressure gas for driving the turbine, and introducing the combustion gas to a nozzle (stationary blade) of a gate of the turbine. Since a liner (inner cylinder) and a transition piece (tail cylinder) in a combustion engine are exposed to the combustion gas at 1500 to 2000° C. and heated to 700 to 900° C. by the exposure, the liner and transition piece are required to maintain their shapes at that temperature. In addition, the liner and the transition piece suffer severe heat cycle of heating and cooling that accompany frequent starting, stopping, and power controlling.

Therefore, a material used in the production of liners and transition pieces of gas-turbine combustors is required to have excellent high-temperature strength such as high-temperature tensile strength, creep-rupture strength, low-cycle fatigue strength, and thermal fatigue strength, and is further required to have high-temperature corrosion resistance such as high-temperature oxidation resistance, and high-temperature sulfidization resistance. In addition, the liners and transition pieces of combustors are produced by hot-working and cold working of various Ni-based heat resistant alloy plates, brazing the plates, and welding the plates. Therefore, the material is also required to have cold-workability, hot-workability, and brazability.

Conventionally, Ni-based heat-resistant alloy has been used as a material for liners and transition pieces of the combustors. Specific examples of the Ni-base heat-resistant alloy which have been used in the prior art include: a solid-solution strengthened type alloy or a slight precipitation-strengthened type alloy represented by Ni-base heat resistant alloy composed of, in mass % (hereafter, % denotes mass %), 22% of Cr, 1.5% of Co, 18.5% of Fe, 9% of Mo, 0.6% of W, 0.1% of C, and a balance of Ni, and Ni-based heat resistant alloy composed of 22% of Cr, 8% of Co, 9% of Mo, 3% of W, 1% of Al, 0.3% of Ti, 0.07% of C, and a balance of Ni; or precipitation strengthened type alloy such as Ni-based heat resistant alloy composed of 20% of Cr, 20% of Co, 5.9% of Mo, 0.5% of Al, 2.1% of Ti, 0.06% of C, and a balance of Ni.

Further, a Ni-based heat resistant alloy of the following constitution has been proposed as a material for a gas turbine engine. The alloy has a composition containing Cr: 15.0 to 30%, Co: 5 to 20%, Mo: 6 to 12.0%, W: up to 5%, Zr: up to 0.5%, Al: 0.5 to 1.5%, Ti: up to 0.75%, C: 0.04 to 0.15%, B: up to 0.02%, Fe: up to 5%, rare earth element: up to 0.2%, and a balance consisting of Ni and unavoidable impurities. The alloy is further characterized by substantially recrystallized fine structure, wherein at least 1 to 2 weight % of the alloy is constituted of $M_6C$ carbide, and lesser % of the alloy is constituted of $M_{23}C_6$ carbide, where the $M_6C$ carbide constitutes at least 50% of existent carbide in the alloy, and crystal grains have an average size of about 3 to about 5 in ASTM#. The $M_6C$ carbide dispersed in the matrix of the Ni-based heat resistant alloy has a diameter of 3 μm or less, TiN phase in an amount of 0.05% or less is included in the matrix of the Ni-based heat resistant alloy, and inter-metallic compound represented by $Ni_3(Al,Ti)$, that is γ' phase, exist in an amount up to 5% (Japanese Unexamined Patent Application, First Publication No. H2-107736).

DISCLOSURE OF INVENTION

Problems to be Solved by the Invention

However, combustion temperature increases in accordance with recent trends for a high-powered gas-turbine, and the gas turbine tends to have a complicated structure because of introduction of steam cooling and the like. In accordance with these trends, there is an increasing demand for high precision in shaping and working of liners and transition pieces of gas turbine combustors made of the above-described conventional Ni-based alloy. In addition, lifetimes of liner and transition piece of the gas-turbine combustor tend to decrease in accordance with increasing output power.

Device for Solving the Problem

Accordingly, the inventors carried out research with an intention to develop a Ni-based heat resistant alloy that can provide liners and transition pieces that can escape from shortening of the lifetime compared to the required machine-life, even when the gas-turbine combustor of a complicated structure is operated at high output power. As a result, it was made clear that constituent members of a liner and a transition piece of a gas turbine must comprise a Ni-based heat resistant alloy having the below-described properties (a) to (c) so as to prolong the machine life of the liner and the transition piece to be at least not shorter than the required lifetime.

(a) Among the various high-temperature strength properties including high-temperature strength, creep-rupture strength, low-cycle fatigue strength, thermal fatigue strength, creep fatigue strength, and the like, the Ni-based heat resistant alloy must have an excellent strength with respect to a creep fatigue, wherein the creep fatigue is generated by applying repeated tension and compression to the alloy, where the alloy is maintained at a maximum-strained state for a predetermined duration only when a tension is applied to the alloy as shown in FIG. 2. In the creep fatigue property under the application of relatively high strain, creep ductility is an important element. In addition, it is important to generate in-grain deformation while avoiding a grain-boundary breakdown. Therefore, the Ni-based heat-resistant alloy has a high ductility while maintaining high strength.

(b) Since the Ni-based heat resistant alloy is exposed to a severe high-temperature environment, the Ni-based heat resistant alloy is excellent in high-temperature corrosion resistance such as high-temperature oxidation resistance and high-temperature sulfidization resistance, so as to bear the above-described environment for a long period of time.

(c) If a large surface roughness is generated in a work surface of the alloy when the alloy is subjected to secondary working to produce a gas-turbine combustor of a complicated shape, a portion of large working rate and a portion of small working rate have a different surface roughness. Heat conductivity is high in the portion of high surface roughness, while the heat conductivity is low in a portion of low surface roughness. As a result, heterogeneity is generated in the thermal gradient or temperature distribution, thereby causing thermal fatigue. Therefore, a plate of the Ni-based heat resistant alloy used in the production of gas-turbine combustor generates surface roughness only in a small level by the working.

In addition, a result described in below (d) was obtained by the research.

(d) A Ni-based heat resistant alloy having the properties described in the above (a) to (c) can be obtained by producing Ni-based heat resistant alloy having excellent workability, comprising: a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%; Fe: 7.0% or less, B: 0.001 to 0.020%, C: 0.03 to 0.15%, further containing, in mass %, Nb: 0.1 to 1.0% according to need, and a balance consisting of Ni and unavoidable impurities, wherein a content of S and P contained in the unavoidable impurities is controlled to be, in mass %, S: 0.015% or less, and P: 0.015% or less, wherein the alloy has a texture in which $M_6C$ type carbide (carbide grains) and MC type carbide are uniformly dispersed in the matrix composed of γ phase, and performing aging treatment of the Ni-based heat resistant alloy, thereby precipitating γ' phase so as to form a texture wherein $M_6C$ type carbide and MC type carbide are uniformly dispersed in the matrix comprising a mixed phase of γ phase and γ' phase.

The present invention was completed based on the above-described research result. A Ni-based heat resistant alloy having excellent workability according to the present invention has the below-described aspects.

(1) A first aspect of a Ni-based heat resistant alloy of the present invention is Ni-based heat resistant alloy for working a gas turbine combustor, the alloy comprising: a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%; Fe: 7.0% or less, B: 0.001 to 0.020%, C: 0.03 to 0.15%, and a balance consisting of Ni and unavoidable impurities, wherein a content of S and P contained in the unavoidable impurities is controlled to be, in mass %, S: 0.015% or less, and P: 0.015% or less, wherein the alloy has a texture in which $M_6C$ type carbide and MC type carbide are uniformly dispersed in the matrix composed of γ phase.

(2) A second aspect of the present invention is Ni-based heat resistant alloy for working a gas-turbine combustor, comprising: a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%; Fe: 7.0% or less, Nb: 0.1 to 1.0%, B: 0.001 to 0.020%, C: 0.03 to 0.15%, and a balance consisting of Ni and unavoidable impurities, wherein a content of S and P contained in the unavoidable impurities is controlled to be, in mass %, S: 0.015% or less, and P: 0.015% or less, wherein the alloy has a texture in which $M_6C$ type carbide and MC type carbide are uniformly dispersed in γ phase matrix.

The inventors further carried out a research about the $M_6C$ type carbide and the MC type carbide, and obtained a result described in the below (e) and (f).

(e) The M in the $M_6C$ type carbide dispersed in the matrix of the Ni-based heat resistant alloy according to the first aspect preferably has a composition containing, in mass %, Ni: 12.0 to 45.0%, Cr: 9.0 to 22.0%, Co: 0.5 to 13.5%, W: 2.0 to 24.0%, Al: 5.0% or less, Ti: 0.5 to 6.0%, and a balance consisting of Mo and unavoidable impurities. In addition, the M in the MC type carbide dispersed in the matrix of the Ni-based heat resistant alloy according to the first aspect preferably has a composition containing, in mass %, Ni: 7.0% or less, Cr: 6.0% or less, Co: 12.0% or less, Mo: 57.0% or less, W: 15% or less, Al: 6.0% or less, and a balance consisting of Ti and unavoidable impurities.

(f) The M in the $M_6C$ type carbide dispersed in the matrix of the Ni-based heat resistant alloy according to the second aspect described in (2) preferably has a composition containing, in mass %, Ni: 12.0 to 45.0%, Cr: 9.0 to 22.0%, Co: 0.5 to 13.5%, W: 2.0 to 24.0%, Al: 5.0% or less, Ti: 0.5 to 6.0%, Nb: 1.0% or less, and a balance consisting of Mo and unavoidable impurities. In addition, the M in the MC type carbide dispersed in the matrix of the Ni-based heat resistant alloy according to the second aspect preferably has a composition containing, in mass %, Ni: 7.0% or less, Cr: 6.0% or less, Co: 12.0% or less, Mo: 57.0% or less, W: 15% or less, Nb: 65% or less, Al: 6.0% or less, and a balance consisting of Ti and unavoidable impurities.

Therefore, a Ni-based heat resistant alloy having excellent workability according to the present invention has the below-described aspects.

(3) A Ni-based heat resistant alloy of a third aspect of the present invention is the Ni-based heat resistant alloy for working a gas turbine combustor according to the above-described first aspect, wherein the M in the $M_6C$ type carbide has a composition containing, in mass %, Ni: 12.0 to 45.0%, Cr: 9.0 to 22.0%, Co: 0.5 to 13.5%, W: 2.0 to 24.0%, Al: 5.0% or less, Ti: 0.5 to 6.0%, and a balance consisting of Mo and unavoidable impurities, and the M in the MC type carbide has a composition containing, in mass %, Ni: 7.0% or less, Cr: 6.0% or less, Co: 12.0% or less, Mo: 57.0% or less, W: 15% or less, Al: 6.0% or less, and a balance consisting of Ti and unavoidable impurities.

(4) A Ni-based heat resistant alloy of a fourth aspect of the present invention is the Ni-based heat resistant alloy having excellent workability for working a gas turbine combustor according to the above-described second aspect, wherein the M in the $M_6C$ type carbide has a composition containing, in mass %, Ni: 12.0 to 45.0%, Cr: 9.0 to 22.0%, Co: 0.5 to 13.5%, W: 2.0 to 24.0%, Al: 5.0% or less, Ti: 0.5 to 6.0%, Nb: 1.0% or less, and a balance consisting of Mo and unavoidable impurities, and the M in the MC type carbide has a composition containing, in mass %, Ni: 7.0% or less, Cr: 6.0% or less, Co: 12.0% or less, Mo: 57.0% or less, W: 15% or less, Nb: 65% or less, Al: 6.0% or less, and a balance consisting of Ti and unavoidable impurities.

A Ni based heat resistant alloy for a gas turbine combustor according to the present invention, having excellent workability and a texture in which $M_6C$ type carbide and MC type carbide are uniformly dispersed in the matrix can be obtained by the following method. Firstly, an ingot is obtained by melting and pouring Ni-based heat resistant alloy having a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%, Fe: 7.0% or less, B: 0.001 to 0.020%, C: 0.03 to 0.15%, where necessary, further containing, in mass %, Nb: 0.1 to 1.0%, and a balance of Ni and unavoidable impurities, wherein a content of S and P contained in the unavoidable impurities is controlled to be, in mass %, S: 0.015% or less and P: 0.015% or less. In a step of subjecting the thus obtained ingot to repeated hot working such as hot-forging and hot-rolling, after heating the ingot to a temperature within a range from γ' solvus (solvus temperature of γ' phase)+20° C. to γ' solvus +200° C., working to a desired product region by a work ratio of 15% or more is performed at least two times or more in a temperature range from the heating temperature to γ' solvus −150° C. Where necessary, the alloy (worked ingot) is further subjected to cold working. After that, the alloy is subjected to solution treatment by heating the alloy to a temperature within a range from γ' solvus +20° C. to γ' solvus +200° C., and subsequently cooling the alloy. The thus obtained Ni-based heat resistant alloy having excellent workability is generally worked to a plate (or sheet).

The Ni-based heat resistant alloy plate/sheet having excellent workability is worked to a predetermined shape of, for example, a liner and a transition piece of a combustor, or the like, by being subjected to secondary working such as press working, bending, and drawing, and the like, and further being subjected to welding. After that, the working is finished by, for example, aging treatment, or the like for enhancing high-temperature strength properties such as low cycle fatigue property, creep fatigue property by further precipitating γ' phase in the γ phase matrix. Although, $M_{23}C_6$ type carbide is also precipitated at the same time of γ' phase precipitation by the above-described aging treatment, influence of the $M_{23}C_6$ type carbide on the creep fatigue strength is not so large compared to $M_6C$ type carbide, MC type carbide, and γ' phase.

By performing aging treatment of the Ni-based heat resistant alloy according to the present invention, it is possible to obtain a texture in which the above-described $M_6C$ type carbide and MC type carbide are uniformly dispersed in a matrix that comprises a mixed phase of γ phase and γ' phase. In the Ni-based heat resistant alloy having this texture, the creep fatigue property, specifically, is excellent, and the other high temperature strength and high temperature ductility are further improved. Therefore, the Ni-based heat resistant alloy has excellent property as a member, such as a liner and a transition piece, of a gas-turbine combustor. The above-described aging treatment is performed by retaining the alloy at a temperature of 650 to 900° C. for 12 to 48 hours.

Accordingly, a Ni-based heat resistant alloy for a gas-turbine combustor, having excellent creep fatigue properties according to the present invention has the below-described aspects.

(5) A Ni-based heat resistant alloy according to the fifth aspect of the present invention is a Ni-based heat resistant alloy for a gas-turbine combustor, comprising a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%, Fe: 7.0% or less, B: 0.001 to 0.020%, C: 0.03 to 0.15%, and a balance consisting of Ni and unavoidable impurities, wherein a content of S and P contained in the unavoidable impurities is controlled to be, in mass %, S: 0.015% or less, and P: 0.015% or less, wherein the alloy has a texture in which $M_6C$ type carbide and MC type carbide are uniformly dispersed in the matrix comprising a mixed phase of γ phase and γ' phase.

(6) A Ni-based heat resistant alloy according to the sixth aspect of the present invention is a Ni-based heat resistant alloy for a gas-turbine combustor, comprising a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%, Fe: 7.0% or less, Nb: 0.1 to 1.0%, B: 0.001 to 0.020%, C: 0.03 to 0.15%, and a balance consisting of Ni and unavoidable impurities, wherein a content of S and P contained in the unavoidable impurities is controlled to be, in mass %, S: 0.015% or less, and P: 0.015% or less, wherein the alloy has a texture in which $M_6C$ type carbide and MC type carbide are uniformly dispersed in the matrix comprising a mixed phase of γ phase and γ' phase.

The M in the $M_6C$ type carbide dispersed in the matrix of the aging-treated Ni-based heat resistant alloy according to the fifth aspect described in the above (5) preferably has a composition containing, in mass %, Ni: 12.0 to 45.0%, Cr: 9.0 to 22.0%, Co: 0.5 to 13.5%, W: 2.0 to 24.0%, Al: 5.0% or less, Ti: 0.5 to 6.0%, and a balance consisting of Mo and unavoidable impurities. In addition, the M in the MC type carbide dispersed in the matrix of the Ni-based heat resistant alloy according to the fifth aspect preferably has a composition containing, in mass %, Ni: 7.0% or less, Cr: 6.0% or less, Co: 12.0% or less, Mo: 57.0% or less, W: 15% or less, Al: 6.0% or less, and a balance consisting of Ti and unavoidable impurities.

The M in the $M_6C$ type carbide dispersed in the matrix of the aging-treated Ni-based heat resistant alloy according to the sixth aspect described in the above (6) preferably has a composition containing, in mass %, Ni: 12.0 to 45.0%, Cr: 9.0 to 22.0%, Co: 0.5 to 13.5%, W: 2.0 to 24.0%, Al: 5.0% or less, Ti: 0.5 to 6.0%, Nb: 1.0% or less, and a balance consisting of Mo and unavoidable impurities. In addition, the M in the MC type carbide dispersed in the matrix of the Ni-based heat resistant alloy according to the sixth aspect preferably has a composition containing, in mass %, Ni: 7.0% or less, Cr: 6.0% or less, Co: 12.0% or less, Mo: 57.0% or less, W: 15% or less, Nb: 65% or less, Al: 6.0% or less, and a balance consisting of Ti and unavoidable impurities.

Accordingly, a Ni-based heat resistant alloy for a gas-turbine combustor, having excellent creep fatigue properties according to the present invention has the below-described aspects.

(7) A Ni-based heat resistant alloy of a seventh aspect of the present invention is the Ni-based heat resistant alloy for a gas turbine combustor according to the above-described fifth aspect, wherein the M in the $M_6C$ type carbide dispersed in the matrix of aging-treated Ni-based heat resistant alloy has a composition containing, in mass %, Ni: 12.0 to 45.0%, Cr: 9.0 to 22.0%, Co: 0.5 to 13.5%, W: 2.0 to 24.0%, Al: 5.0% or less, Ti: 0.5 to 6.0%, and a balance consisting of Mo and unavoidable impurities, and the M in the MC type carbide has a composition containing, in mass %, Ni: 7.0% or less, Cr: 6.0% or less, Co: 12.0% or less, Mo: 57.0% or less, W: 15% or less, Al: 6.0% or less, and a balance consisting of Ti and unavoidable impurities.

(8) A Ni-based heat resistant alloy of a fourth aspect of the present invention is the Ni-based heat resistant alloy for a gas turbine combustor according to the above-described sixth aspect, wherein the M in the $M_6C$ type carbide dispersed in the matrix of aging-treated Ni-based heat resistant alloy has a composition containing, in mass %, Ni: 12.0 to 45.0%, Cr: 9.0 to 22.0%, Co: 0.5 to 13.5%, W: 2.0 to 24.0%, Al: 5.0% or less, Ti: 0.5 to 6.0%, Nb: 1.0% or less, and a balance consisting of Mo and unavoidable impurities, and the M in the MC type carbide has a composition containing, in mass %, Ni: 7.0% or less, Cr: 6.0% or less, Co: 12.0% or less, Mo: 57.0% or less, W: 15% or less, Nb: 65% or less, Al: 6.0% or less, and a balance consisting of Ti and unavoidable impurities.

It is more preferable that the $M_6C$ type carbide and the MC type carbide uniformly dispersed in the matrix of Ni-based heat resistant alloy for a gas-turbine combustor described in the above (1) to (8) respectively have an average grain diameter of 0.3 to 4.0 μm, and the $M_6C$ type carbide and the MC type carbide are uniformly dispersed in the matrix such that total proportion of those carbide is 0.5 to 16.0 area %. Accordingly, a ninth aspect of the present invention has the below-described constitution.

(9) A Ni-based heat resistant alloy for gas-turbine combustor according to a ninth aspect of the present invention is the Ni-based heat resistant alloy for a gas-turbine combustor according to any one of the above-described first, second, third, fourth, fifth, sixth, seventh, and eighth aspects, wherein each of the $M_6C$ type carbide and the MC type carbide has an average grain diameter of 0.3 to 4.0 μm, and the $M_6C$ type carbide and the MC type carbide uniformly dispersed in the matrix at a total proportion of 0.5 to 16.0 area %.

Next, the reason for limiting the composition and the texture of the Ni-based heat resistant alloy for gas-turbine combustor according to the present invention is explained in the following.

[1] Composition (a) Chromium (Cr)

A Cr component enhances high temperature corrosion resistance such as high temperature oxidation resistance and high temperature sulfidization resistance of the alloy by forming a satisfactory protection film, and contributes to the refining of grain size by increasing solid-solubilizing temperature of $M_6C$ type carbide to the matrix. In addition, the Cr component suppresses the secondary recrystallization and crystal grain-growth in the time of secondary working, thereby improving grain boundary strength. Further, the Cr component forms MC type carbide with C and contributes to the refining of crystal grain size by growing the MC type carbide generated using Ti as the main component to have a desired grain size and an area ratio. In addition, the Cr component has an effect of suppressing recrystallization and crystal grain-growth in the time of secondary working, and further has an effect of improving grain boundary strength by generating $M_{23}C_6$ type carbide by aging treatment. However, if the content of Cr in mass % is less than 14.0%, desired high temperature corrosion resistance cannot be ensured. On the other hand, if the content of Cr exceeds 21.5%, disadvantageous phases such as a phase and p phase are generated, thereby deteriorating high temperature corrosion resistance. Therefore, the content of Cr was determined to be 14.0 to 21.5% in mass %. More preferable range of the Cr content is 15.5 to 20.0% in mass %.

(b) Cobalt (Co)

A Co component is mainly solid-solubilized in the matrix (γ phase) and enhances the creep property. Further, Co and C form MC type carbide and contributes to refining of crystal grain size by growing the MC type carbide generated using Ti as the main component to a desired grain size and area ratio. However, if the Co content is less than 6.5%, it is not preferable since sufficient creep property cannot be provided. On the other hand, if the Co content exceeds 14.5%, it is not preferable since hot-workability is reduced and high temperature ductility during the use of combustor or the like is deteriorated. Therefore, the content of Co was determined to be 6.5 to 14.5% in mass %. A more preferable range of Co content is 7.5 to 13.5% in mass %.

(c) Molybdenum (Mo)

A Mo content has an effect of improving the high temperature tensile property, the creep property, and the creep fatigue property, by being solid-solubilized in the matrix (γ phase), and the effect exerts combined-effect by the coexistence with W. Further, Mo and C form $M_6C$ type carbide, strengthen the grain boundaries, and suppress recrystallization and crystal grain-growth in the time of secondary working. Mo forms MC type carbide with C and contributes to the refining of crystal grain size by growing the MC type carbide generated using Ti as the main component to a desired grain size and area ratio, and also has an effect of suppressing recrystallization and crystal grain-growth in the time of secondary working. However, if the Mo content is less than 6.5% in mass %, a sufficient high temperature ductility and creep fatigue property cannot be provided. On the other hand, if Mo content exceeds 10.0%, it is not preferable since the hot-workability is deteriorated and disadvantageous phases such as p phase are precipitated, thereby causing brittleness. Therefore, the Mo content was determined to be 6.5 to 10.0% in mass %. A more preferable range of Mo content is 7.0 to 9.5% in mass %.

(d) Tungsten (W)

A W component is solid-solubilized in the matrix (γ phase) and γ' phase, and improves high-temperature tensile strength, the creep property, and the creep fatigue property. Under the coexistence with Mo, W exhibits a combined strengthening by solid-solution strengthening of the matrix. Further, W forms $M_6C$ type carbide, strengthens the grain boundaries, and suppress recrystallization and crystal grain-growth in the time of secondary working. Further, W forms MC type carbide with C and contributes to the refining of crystal grain size by growing the MC type carbide generated using Ti as the main component to a desired grain size and area ratio, and also has an effect of suppressing recrystallization and crystal grain-growth in the time of secondary working. If the W content is less than 1.5% in mass %, a sufficient high-temperature ductility and creep fatigue property cannot be provided. On the other hand, if the W content exceeds 3.5%, it is not preferable since hot workability is deteriorated, and ductility is reduced. Therefore, the W content was determined to be 1.5 to 3.5% in mass %. A more preferable range of W content is 2.0 to 3.0% in mass %.

(e) Aluminum (Al)

By suffering the aging treatment, an Al component constitutes γ' phase ($Ni_3Al$) as a main precipitation strengthening phase, and improves the high-temperature tensile property, the creep property, and the creep fatigue property, and provides high temperature strength. Further, Al forms a MC type carbide with C and contributes to the refining of crystal grain size by growing the MC type carbide generated using Ti as the main component to a desired grain size and area ratio, and also has an effect of suppressing recrystallization and crystal grain-growth in the time of secondary working. However, where the Al content is less than 1.2% in mass %, it is impossible to ensure a desired high temperature strength because of the insufficient precipitation ratio of the γ' phase. On the other hand, if the Al content exceeds 2.4%, it is not preferable since hot workability is deteriorated and γ' phase has an excessive amount, thereby deteriorating ductility. Therefore, the Al content was determined to be 1.2 to 2.4% in mass %. A more preferable range of Al content is 1.4 to 2.2% in mass %.

(f) Titanium (Ti)

A Ti component is mainly solid-solubilized in γ' phase and improves the high-temperature tensile property, the creep property, and the creep fatigue property, and provides high temperature strength. Further, Ti forms a MC type carbide with C and refines grain size, and suppresses secondary recrystallization and crystal grain growth in the time of a secondary working, and improves grain boundary strength. However, if the Ti content is less than 1.1%, a desired high-temperature strength cannot be ensured because of the insufficient precipitation ratio of the γ' phase. On the other hand, if the Ti content exceeds 2.1%, it is not preferable since hot-workability is deteriorated. Therefore, Ti content was determined to be 1.1 to 2.1% in mass %. A more preferable range of Ti content is 1.3 to 1.9% in mass %.

(g) Boron (B)

A B component forms a $M_3B_2$ type boride with Cr, Mo and the like, enhances grain boundary strength, and suppress crystal grain growth. However, where the B content is less than 0.001% in mass %, it is impossible to obtain sufficient grain-boundary strengthening ability and grain boundary pinning effect because of the insufficient amount of boride. On the other hand, where the B content exceeds 0.020%, it is not preferable since too excessive amount of boride is generated, thereby deteriorating hot-workability, weldability, ductility and the like. Therefore, the B content was determined to be 0.001 to 0.020% in mass %. A more preferable range of B content is 0.002 to 0.010% in mass.

(h) Carbon (C)

A C component forms $M_6C$ type and MC type carbides with Ti, Mo and the like and contributes to the refining of crystal grains, suppresses secondary recrystallization and crystal grain growth in the time of secondary working, and improves grain boundary strength. Further, C generates $M_{23}C_6$ type carbide by the aging treatment, thereby improving grain boundary strength. However, where the C content is less than 0.03% in mass %, it is impossible to obtain sufficient grain boundary strengthening ability and grain boundary pinning effect because of an insufficient precipitation ratio of $M_6C$ type and MC type carbides. On the other hand, if the C content is more than 0.15%, it is not preferable since too excessive amount of carbides are generated, thereby deteriorating hot-workability, weldability, ductility and the like. Therefore, the C content was determined to be 0.03 to 0.15% in mass %. A more preferable range of the C content is 0.05 to 0.12%.

(i) Iron (Fe)

Where necessary, an Fe component is added since Fe is inexpensive and has an effect of improving hot-workability. However, if the Fe content exceeds 7% in mass %, it is not preferable since high temperature strength is deteriorated. The Fe content was determined to be 7.0% or less (including 0%) in mass %, more preferably, 4% or less in mass %.

(i) Sulfur (S) and Phosphorus (P)

Both of S and P segregate in the grain boundaries and cause weakening of the grain boundaries, thereby causing deterioration of creep fatigue strength, and deteriorating weldability. Therefore, it is preferable to control S and P contents to be as low as possible. However, as the upper limit of content, at most, 0.015% in mass % is allowable. Therefore, it was determined that S<0.015% in mass %, and P<0.015% in mass %.

(k) Niobium (Nb)

A Nb component is solid-solubilized in the matrix (γ phase) and the γ' phase, and improves the high temperature tensile property, the creep property, the creep fatigue property, thereby providing high temperature strength. Further, Nb forms MC type carbide with C, refines crystal grains, suppress secondary recrystallization and crystal grain growth in the time of secondary working, and enhances the grain boundary strength. Therefore, Nb is added according to need. However, where the Nb content is less than 0.1% in mass %, it is impossible to provide a sufficient creep fatigue property. On the other hand, if the Nb content exceeds 1.0%, it is not preferable since hot-workability is deteriorated. Therefore, the Nb content was determined to be 0.1 to 1.0% in mass %. A more preferable range of Nb content is 0.2 to 0.8% in mass %.

[II] Carbide

An ingot is obtained from molten alloy of Ni-based heat resistant alloy comprising a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%, Fe: 7.0% or less, B: 0.001 to 0.020%, C: 0.03 to 0.15%, further containing Nb: 0.1 to 1.0% according to need, and a balance consisting of Ni and unavoidable impurities, wherein a content of S and P contained in the unavoidable impurities is controlled, in mass %, S: 0.015% or less; P: 0.015% or less. In a step of subjecting the thus obtained ingot to repeated hot working including hot-forging and hot-rolling, after heating the ingot to a temperature within a range from γ' solvus (solvus temperature of γ' phase)+20° C. to γ' solvus +200° C., working to a desired product region by a work ration of 15% or more is performed at least two times or more in a temperature range from the heating temperature to γ' solvus −150° C. Where necessary, the work (worked ingot) is subjected to cold working. After that, the work is subjected to a solution treatment by heating the work to a temperature within a range from γ' solvus +20° C. to γ' solvus +200° C., and subsequently cooling the work. By the above-described treatments, $M_6C$ type carbide and MC type carbide having an average grain diameter of 0.3 to 4.0 μm are formed in the matrix of a Ni-based heat resistant alloy at an area % of 0.5 to 16.0%. The composition of the M in the $M_6C$ type carbide comprises, in mass %, Ni: 12.0 to 45.0%, Cr: 9.0 to 22.0%, Co: 0.5 to 13.5%, W: 2.0 to 24.0%, Al: 5.0% or less, Ti: 0.5 to 6.0%, further containing Nb: 1.0% or less according to need, and a balance consisting of Mo and unavoidable impurities. In addition, the M in the MC type carbide has a composition comprising, in mass %, Ni: 7.0% or less Cr: 6.0% or less, Co: 12.0% or less, Mo: 57.0% or less, W: 15% or less, Al: 6.0% or less, further containing Nb: 65% or less according to need, and a balance consisting of Ti and unavoidable impurities.

The $M_6C$ type carbide and the MC type carbide uniformly dispersed in the matrix of the Ni-based heat resistant alloy of the present invention respectively have a grain boundary pinning effect. However, when the average grain diameter is less than 0.3 μm, it is not preferable since the pinning effect is not sufficient because of too fine size, and it is impossible to suppress secondary recrystallization and crystal grain growth in the time of reheating after the solution treatment. Where the average grain diameter exceeds 4.0 μm, it is not preferable since large $M_6C$ type carbide and the MC type carbide serve as initiation points and path of cracking during the application under a creep fatigue, thereby causing shortening of lifetime. Therefore, grain sizes of $M_6C$ type carbide and MC type carbide uniformly dispersed in the matrix of the Ni-based heat resistant alloy according to the present invention was determined to be average grain diameter: 0.3 to 4.0 μm. More preferable average grain diameter of the $M_6C$ type carbide and MC type carbide uniformly dispersed in the matrix of the Ni-based heat resistant alloy of the present invention is 0.4 to 3.0 μm.

Where the area ratio of the $M_6C$ type carbide and MC type carbide uniformly dispersed in the matrix of the Ni-based heat resistant alloy is less than 0.5%, it is not preferable since a sufficient effect cannot be exerted. On the other hand, where the area ratio of generated carbides exceeds 16.0%, it is not preferable since ductility is reduced, the bending property and the deep drawability are deteriorated, and further serve as initiation points and path of cracking during the operation, thereby resulting short lifetime. Therefore, area ratio of the $M_6C$ type carbide and the MC type carbide uniformly dispersed in the matrix of the Ni-based heat resistant alloy according to the present invention was determined to be 0.5 to 16.0%. A more preferable area ratio of the $M_6C$ type carbide and MC type carbide uniformly dispersed in the matrix of the Ni-based heat resistant alloy of the present invention is 1.5 to 13.0%.

Effect of the Invention

As described above, the Ni-based heat resistant alloy according to the present invention exhibits excellent performance when it is used in various parts of gas-turbine, especially in liner or transition piece in the combustor of gas-turbine.

BEST MODE FOR CARRYING OUT THE INVENTION

Figure 1:
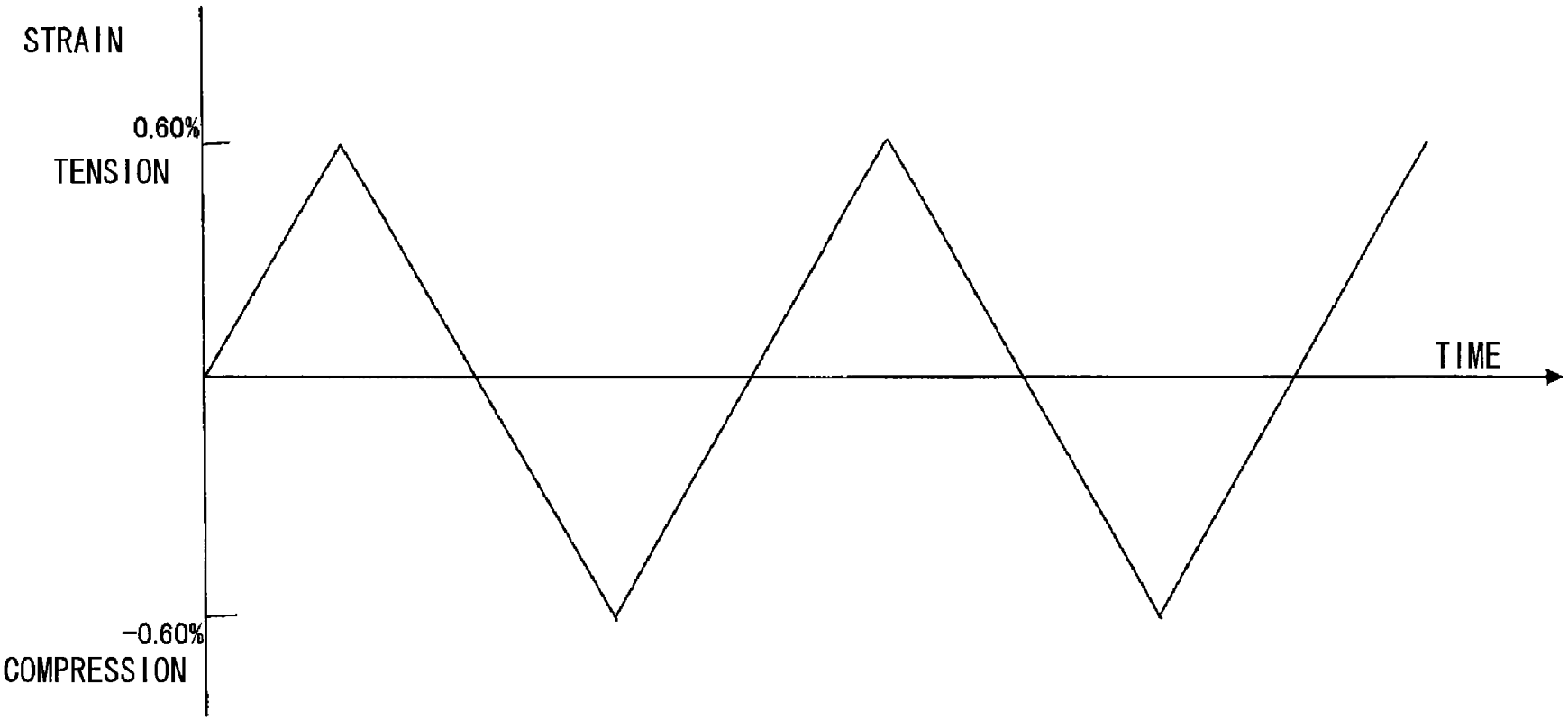
FIG. 1 is a drawing for explaining a wave-form of strain in the low-cycle fatigue test.

Next, the Ni-based heat resistant alloy according to the present invention is explained specifically based on the embodiments.

Using a conventional high-frequency vacuum induction melting furnace, molten alloys of Ni-based heat resistant alloy were produced by melting Inventive Ni-based heat resistant alloy 1-16, Comparative Ni-based heat resistant alloys 1-18, and Conventional Ni-based heat resistant alloy each having a composition shown in Tables 1 to 3. Ingots each having a diameter of 100 mm and a height of 150 mm were produced by casting the molten alloys. Hot-forged bodies each having a thickness of 50 mm, a width of 120 mm, and a length of 200 mm were produced by hot-forging the ingots.

In Tables 1-3, a * mark denotes a value outside the conditions of the present invention.

TABLE 1

| Ni-BASED HEAT-RESISTANT ALLOY | | COMPOSITION (mass %) (BALANCE INCLUDING UNAVOIDABLE IMPURITIES) | | | | | | | | | | | | |
|---|---|---|---|---|---|---|---|---|---|---|---|---|---|---|
| | | Cr | Co | Mo | W | Al | Ti | B | C | Fe | S | P | Nb | Ni |
| PRESENT INVENTION | 1 | 18.4 | 12.4 | 8.1 | 2.4 | 1.6 | 1.7 | 0.003 | 0.08 | 0.1 | <0.001 | 0.002 | — | BALANCE |
| | 2 | 18.2 | 12.4 | 6.6 | 3.0 | 1.7 | 1.6 | 0.006 | 0.10 | 0.1 | <0.001 | 0.002 | — | BALANCE |
| | 3 | 18.0 | 12.5 | 7.1 | 2.9 | 1.9 | 1.4 | 0.002 | 0.12 | 0.1 | <0.001 | <0.001 | — | BALANCE |
| | 4 | 18.9 | 12.2 | 7.4 | 2.4 | 1.8 | 1.6 | 0.003 | 0.15 | 0.1 | <0.001 | <0.001 | — | BALANCE |
| | 5 | 14.3 | 11.8 | 7.7 | 2.5 | 1.7 | 1.7 | 0.004 | 0.09 | 0.2 | 0.001 | 0.002 | — | BALANCE |
| | 6 | 19.2 | 11.5 | 8.1 | 2.3 | 1.5 | 1.8 | 0.003 | 0.07 | 0.2 | 0.002 | 0.001 | — | BALANCE |
| | 7 | 18.1 | 12.3 | 8.5 | 2.6 | 1.9 | 1.5 | 0.018 | 0.04 | 0.1 | <0.001 | <0.001 | — | BALANCE |
| | 8 | 18.3 | 12.2 | 8.8 | 2.4 | 1.6 | 1.8 | 0.003 | 0.08 | 0.1 | <0.001 | <0.001 | — | BALANCE |
| | 9 | 21.3 | 11.6 | 9.0 | 2.5 | 1.6 | 1.6 | 0.005 | 0.09 | 0.1 | 0.001 | 0.001 | — | BALANCE |
| | 10 | 18.5 | 12.1 | 9.3 | 2.6 | 1.7 | 1.6 | 0.004 | 0.08 | 0.1 | <0.001 | <0.001 | — | BALANCE |
| | 11 | 18.8 | 12.0 | 9.6 | 2.4 | 1.5 | 1.7 | 0.003 | 0.07 | 0.2 | 0.001 | 0.002 | — | BALANCE |
| | 12 | 18.6 | 11.5 | 9.9 | 2.2 | 1.6 | 1.8 | 0.004 | 0.06 | 0.1 | 0.001 | 0.002 | 0.2 | BALANCE |
| | 13 | 18.2 | 12.4 | 8.5 | 1.7 | 1.9 | 1.3 | 0.005 | 0.10 | 0.1 | <0.001 | <0.001 | 0.7 | BALANCE |
| | 14 | 19.0 | 12.2 | 8.2 | 1.9 | 1.7 | 1.4 | 0.004 | 0.08 | 0.1 | 0.002 | 0.003 | 0.5 | BALANCE |
| | 15 | 16.9 | 8.9 | 7.5 | 2.5 | 1.8 | 1.7 | 0.004 | 0.08 | 0.3 | <0.001 | 0.002 | 0.5 | BALANCE |

TABLE 2

| Ni-BASED HEAT-RESISTANT ALLOY | | COMPOSITION (mass %) (BALANCE INCLUDING UNAVOIDABLE IMPURITIES) | | | | | | | | | | | | |
|---|---|---|---|---|---|---|---|---|---|---|---|---|---|---|
| | | Cr | Co | Mo | W | Al | Ti | B | C | Fe | S | P | Nb | Ni |
| PRESENT INVENTION | 16 | 18.7 | 12.3 | 8.2 | 3.1 | 1.6 | 1.7 | 0.002 | 0.09 | 0.2 | 0.001 | 0.003 | — | BALANCE |
| | 17 | 18.9 | 11.9 | 8.0 | 3.3 | 1.4 | 1.9 | 0.004 | 0.10 | 0.2 | 0.002 | 0.004 | — | BALANCE |
| | 18 | 18.5 | 12.6 | 8.4 | 2.7 | 2.3 | 1.2 | 0.005 | 0.11 | 0.2 | 0.001 | 0.002 | — | BALANCE |
| | 19 | 18.6 | 14.3 | 8.5 | 2.4 | 1.5 | 1.5 | 0.004 | 0.08 | 0.1 | <0.001 | <0.001 | — | BALANCE |
| | 20 | 18.4 | 6.7 | 8.2 | 2.5 | 1.8 | 1.8 | 0.003 | 0.08 | 0.1 | <0.001 | <0.001 | — | BALANCE |
| | 21 | 17.8 | 11.6 | 8.1 | 2.3 | 1.3 | 2.0 | 0.003 | 0.10 | 0.2 | <0.001 | 0.001 | — | BALANCE |
| | 22 | 15.6 | 12.2 | 8.3 | 2.2 | 2.1 | 1.4 | 0.008 | 0.06 | 0.2 | <0.001 | <0.001 | — | BALANCE |
| | 23 | 19.8 | 11.8 | 8.4 | 2.5 | 1.7 | 1.6 | 0.003 | 0.09 | 0.2 | 0.002 | 0.003 | — | BALANCE |
| | 24 | 18.4 | 7.6 | 8.1 | 2.4 | 1.6 | 1.7 | 0.004 | 0.08 | 0.1 | 0.001 | 0.001 | — | BALANCE |
| | 25 | 18.0 | 13.4 | 8.2 | 2.4 | 1.5 | 1.7 | 0.004 | 0.08 | 0.2 | <0.001 | 0.001 | — | BALANCE |
| | 26 | 18.5 | 12.0 | 8.5 | 1.7 | 1.8 | 1.8 | 0.003 | 0.09 | 0.2 | 0.001 | 0.002 | — | BALANCE |
| COMPARATIVE | 1 | 21.6* | 10.2 | 9.8 | 3.3 | 2.0 | 1.8 | 0.004 | 0.08 | 1.0 | 0.008 | 0.010 | 0.8 | BALANCE |
| | 2 | 13.9* | 13.8 | 7.3 | 1.8 | 1.2 | 1.4 | 0.003 | 0.04 | 0.2 | <0.001 | 0.001 | 0.2 | BALANCE |
| | 3 | 20.3 | 14.6* | 8.9 | 2.9 | 2.3 | 1.9 | 0.006 | 0.11 | 1.5 | 0.002 | 0.002 | 0.7 | BALANCE |
| | 4 | 14.7 | 6.4* | 7.1 | 1.9 | 1.4 | 1.1 | 0.002 | 0.05 | 0.1 | 0.004 | 0.002 | 0.3 | BALANCE |

TABLE 3

| Ni-BASED HEAT-RESISTANT ALLOY | | COMPOSITION (mass %) (BALANCE INCLUDING UNAVOIDABLE IMPURITIES) | | | | | | | | | | | | |
|---|---|---|---|---|---|---|---|---|---|---|---|---|---|---|
| | | Cr | Co | Mo | W | Al | Ti | B | C | Fe | S | P | Nb | Ni |
| COMPARATIVE | 5 | 19.5 | 13.5 | 10.1* | 3.4 | 2.2 | 1.9 | 0.009 | 0.13 | 0.2 | 0.002 | 0.004 | — | BALANCE |
| | 6 | 18.4 | 7.2 | 6.4* | 1.7 | 1.3 | 1.3 | 0.002 | 0.04 | 0.1 | <0.001 | 0.001 | — | BALANCE |
| | 7 | 19.2 | 13.7 | 9.9 | 3.6* | 2.2 | 2.0 | 0.007 | 0.14 | 0.1 | 0.002 | 0.002 | — | BALANCE |
| | 8 | 18.3 | 7.5 | 6.6 | 1.4* | 1.3 | 1.2 | 0.003 | 0.03 | 0.2 | <0.001 | <0.001 | — | BALANCE |
| | 9 | 18.7 | 13.2 | 9.7 | 3.2 | 2.5* | 2.0 | 0.008 | 0.13 | 0.2 | <0.001 | <0.001 | — | BALANCE |
| | 10 | 19.3 | 6.9 | 6.6 | 1.7 | 1.1* | 1.2 | 0.002 | 0.05 | 0.4 | 0.002 | 0.003 | — | BALANCE |
| | 11 | 20.5 | 13.6 | 9.8 | 3.3 | 2.2 | 2.2* | 0.011 | 0.12 | 0.3 | 0.003 | 0.002 | — | BALANCE |
| | 12 | 18.6 | 6.8 | 6.7 | 1.6 | 1.4 | 1.0* | 0.003 | 0.06 | 0.5 | 0.001 | 0.001 | — | BALANCE |
| | 13 | 20.8 | 12.3 | 9.1 | 3.1 | 1.9 | 2.0 | 0.021* | 0.14 | 0.2 | 0.003 | 0.004 | — | BALANCE |
| | 14 | 19.8 | 8.1 | 7.2 | 1.8 | 1.4 | 1.2 | 0.001 | 0.03 | 0.3 | 0.002 | 0.002 | — | BALANCE |
| | 15 | 19.5 | 13.2 | 9.8 | 3.2 | 2.1 | 1.9 | 0.006 | 0.16* | 0.5 | 0.002 | 0.003 | — | BALANCE |
| | 16 | 15.0 | 7.9 | 6.8 | 1.6 | 1.5 | 1.1 | 0.003 | 0.02* | 0.2 | <0.001 | <0.001 | — | BALANCE |
| | 17 | 20.7 | 13.0 | 9.6 | 2.9 | 2.2 | 1.9 | 0.005 | 0.10 | 3.2 | 0.015 | 0.010 | — | BALANCE |
| | 18 | 20.1 | 12.8 | 9.8 | 3.3 | 2.0 | 2.0 | 0.006 | 0.15 | 2.9 | 0.012 | 0.015 | — | BALANCE |
| CONVENTIONAL | | 21.8 | 7.9 | 8.9 | 3.0 | 1.0 | 0.3 | — | 0.07 | — | — | — | — | BALANCE |

Hot-rolled plates each having a thickness of 5 mm or a thickness of 20 mm were obtained by further hot-rolling the hot-forged bodies. The thus obtained hot-rolled plates were subjected to solution treatment by retaining each plate at a temperature of 1100° C. for 10 minutes and subsequently air-cooling the plate, thereby obtaining solution-treated plates A having a thickness of 5 mm, and solution-treated plates B having a thickness of 20 mm made of the Inventive Ni-based heat resistant alloys 1-26, Comparative Ni-based heat resistant alloys 1-18, and Conventional Ni-based heat resistant alloy. Each of the plates had a composition shown in Tables 1 to 3, and had a texture in which $M_6C$ type carbide and MC type carbide each having an average grain diameter shown in Tables 4 to 6 were dispersed in the matrix at an area ratio shown in Tables 4 to 6.

Further, aging-treated plates A having a thickness of 5 mm were produced by subjecting the solution-treated plates A having a thickness of 5 mm to an aging by retaining each plate at a temperature of 850° C. for 24 hours, air-cooling the plate, further retaining the plate at 760° C. for 16 hours, and subsequently air-cooling the plate. In addition, aging-treated plates B having a thickness of 20 mm were produced by subjecting the solution-treated plates B having a thickness of 20 mm to an aging by retaining each plate at a temperature of 850° C. for 24 hours, air-cooling the plate, further retaining the plate at 760° C. for 16 hours, and subsequently air-cooling the plate.

Figure 3:
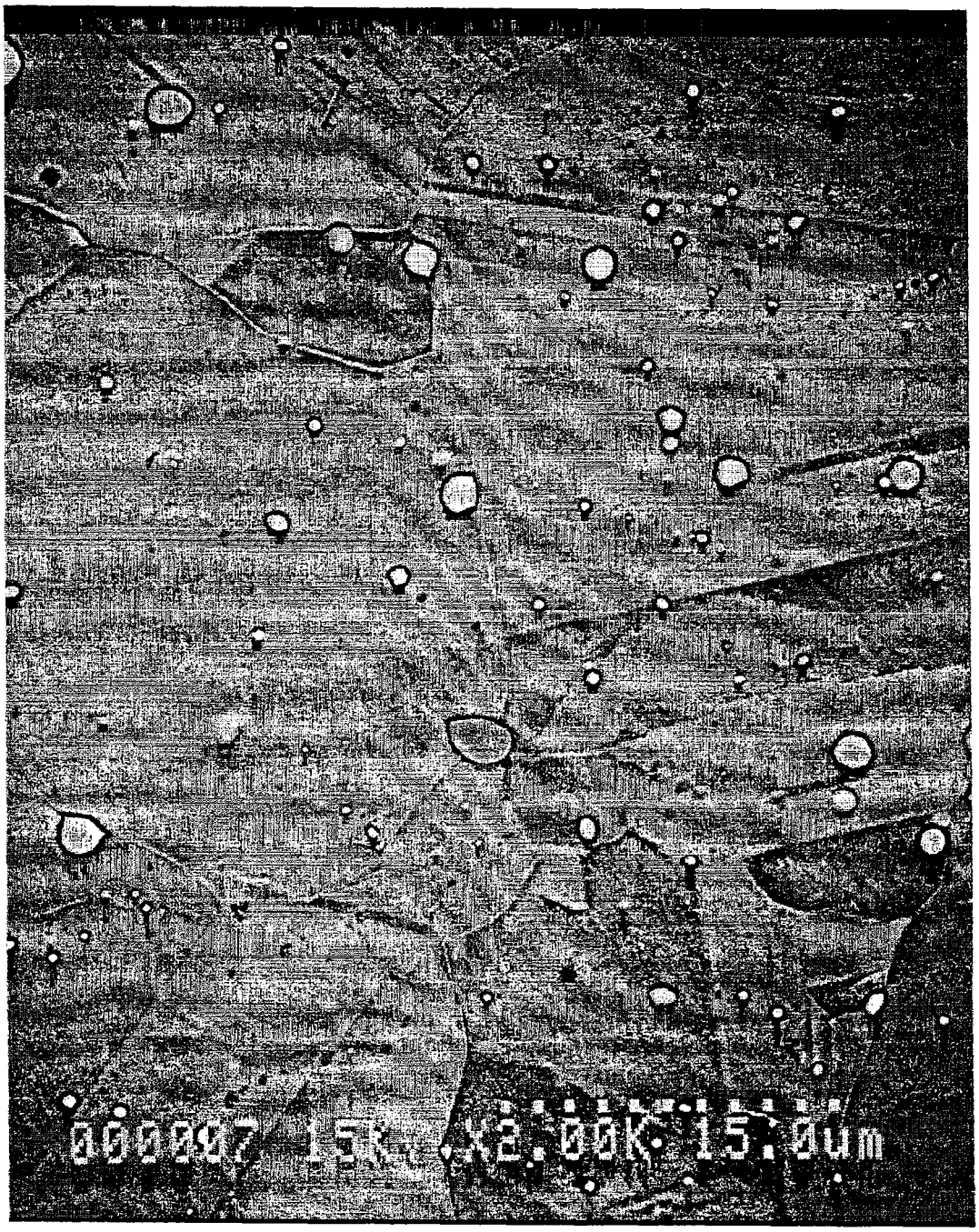
FIG. 3 is a back-scattered electron image (compositional image) of a texture of a solution-treated member.

Average grain diameters and area ratios of $M_6C$ type carbide and MC type carbide dispersed in the matrix of the solution-treated plates B made of Inventive Ni-based heat-resistant alloys 1 to 26, Comparative Ni-based heat resistant alloys 1 to 18, and Conventional Ni-based heat resistant alloy are measured by taking a photograph of the metallographic texture of each Ni-based heat-resistant alloy at a magnification of 400, and subjecting the photograph of the metallographic texture to image analysis. The results are shown in Tables 4 to 6. Further, so as to explain the specific texture of the Ni-based heat resistant alloy of the present invention, as an example, back-scattered electron image (compositional image) of a texture of solution-treated plate A of Inventive Ni-base heat resistant alloy 1 was taken at a magnification of 2000 and was shown in FIG. 3. As it is obvious from FIG. 3, $M_6C$ type carbide and MC type carbide are dispersed in the matrix of γ phase, and the $M_6C$ type carbide are dispersed in larger amount than the MC type carbide.

Figure 4:
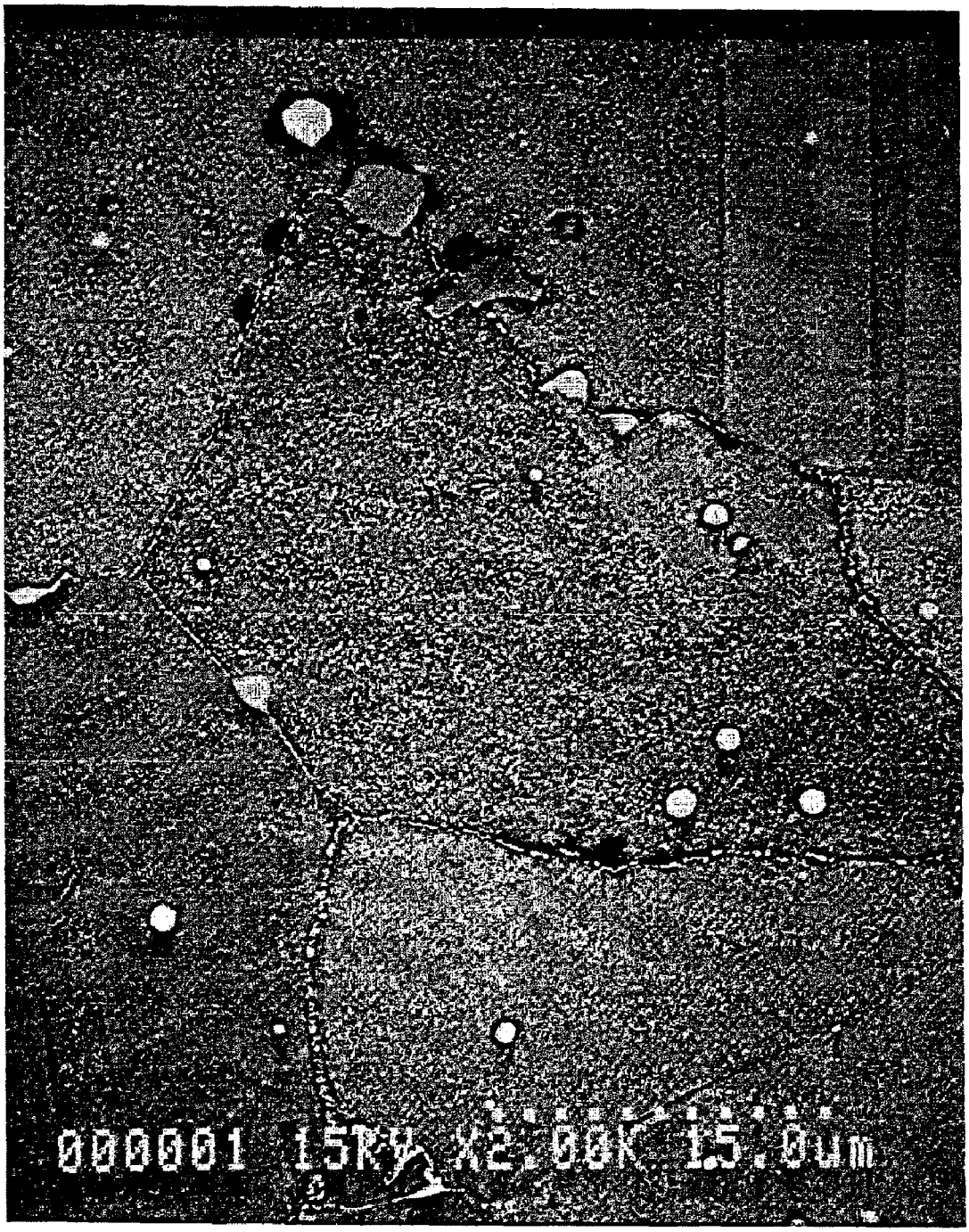
FIG. 4 is a back-scattered electron image (compositional image) of a texture of an aging-treated member.

Further, back scattered electron images (compositional images) of textures of aging-treated plates A made of Inventive Ni-base heat resistant alloys 1 to 26, Comparative Ni-based heat resistant alloys 1 to 18, and Conventional Ni-based heat resistant alloy were taken at a magnification of 2000 and were subjected to observation. As an example, FIG. 4 shows the texture of an aging-treated plate A made of Inventive Ni-based heat resistant alloy 1. The rough appearance of the surface of the matrix in FIG. 4 indicates a mixing of γ' phase and the γ phase matrix. Average grain diameters and area ratios of $M_6C$ type carbide and MC type carbide in the aging-treated plates A are substantially the same as those of the solution-treated plates A, and there is no difference other than the fine dispersion of $M_{23}C_6$ carbide in grain boundaries and mixing of the γ' phase and the γ phase matrix. Therefore, measurements of average grain diameters and area ratios of $M_6C$ type carbide and MC type carbide were omitted.

EXAMPLE

Example 1

The preliminary prepared solution-treated plates A having a thickness of 5 mm, made of Inventive Ni-base heat resistant alloys 1 to 26, Comparative Ni-base heat resistant alloys 1 to 18, and a Conventional Ni-based heat resistant alloy were used in the below-described test working and workability of the plates were evaluated.

A. Bending Test

Test pieces each having a thickness of 5 mm, a width of 20 mm, and a length of 100 mm were obtained from the solution-treated plates A made of Inventive Ni-based heat resistant alloys 1 to 26, Comparative Ni-based heat resistant alloys 1 to 18, and a Conventional Ni-base heat resistant alloy. Those test pieces were subjected to a bending test of R=10 mm and an angle of 180°, and existence/absence of cracking and surface roughness in the bended portion were examined. The results are shown in Tables 4 to 6.

B. Hole Expansion Test

Ring shaped specimens were obtained from the solution-treated plates A made of Inventive Ni-based heat resistant alloys 1 to 26, Comparative Ni-based heat resistant alloys 1 to 18, and Conventional Ni-base heat resistant alloy. Each specimen had a thickness of 5 mm, an outer diameter of 140 mm, and an inner diameter of 20 mm. The hole expansion test of the ring-shaped specimens was performed by expanding the perforation having an inner diameter of 20 mm at an expansion ratio of 35%. The existence/absence of cracks in the expanded perforation and surface roughness in the vicinity of the perforation were examined. The results are shown in Tables 4 to 6.

TABLE 4

| Ni-BASED HEAT-RESISTANT ALLOY | | REMARK | MC TYPE CARBIDE AND $M_6C$ TYPE CARBIDE UNIFORMLY DISPERSED IN γ PHASE MATRIX: AVERAGE GRAIN DIAMETER (μm) | MC TYPE CARBIDE AND $M_6C$ TYPE CARBIDE UNIFORMLY DISPERSED IN γ PHASE MATRIX: AREA RATIO (%) | BENDING TEST: ABSENCE OR EXISTENCE OF CRACKING | BENDING TEST: SURFACE ROUGHNESS (Ra) | HOLE EXPANSION TEST: ABSENCE OR EXISTENCE OF CRACKING | HOLE EXPANSION TEST: SURFACE ROUGHNESS (Ra) |
|---|---|---|---|---|---|---|---|---|
| INVENTIVE | 1 | CONTINUED | 1.4 | 8.5 | ABSENT | 5.3 | ABSENT | 4.3 |
| | 2 | FROM | 1.5 | 7.9 | ABSENT | 5.2 | ABSENT | 4.4 |
| | 3 | TABLE 1 | 1.6 | 9.7 | ABSENT | 5.2 | ABSENT | 4.1 |
| | 4 | | 2.5 | 15.9 | ABSENT | 4.7 | ABSENT | 4.0 |
| | 5 | | 1.5 | 7.2 | ABSENT | 5.3 | ABSENT | 4.5 |
| | 6 | | 1.4 | 5.5 | ABSENT | 5.1 | ABSENT | 4.4 |
| | 7 | | 0.6 | 2.2 | ABSENT | 4.5 | ABSENT | 3.9 |
| | 8 | | 1.4 | 6.5 | ABSENT | 5.2 | ABSENT | 4.3 |
| | 9 | | 1.5 | 7.4 | ABSENT | 4.7 | ABSENT | 4.0 |
| | 10 | | 1.4 | 6.6 | ABSENT | 4.7 | ABSENT | 3.9 |
| | 11 | | 1.4 | 5.7 | ABSENT | 4.8 | ABSENT | 4.1 |
| | 12 | | 1.4 | 4.9 | ABSENT | 4.9 | ABSENT | 4.1 |
| | 13 | | 1.4 | 8.2 | ABSENT | 4.7 | ABSENT | 4.0 |
| | 14 | | 1.4 | 6.4 | ABSENT | 5.0 | ABSENT | 4.2 |
| | 15 | | 1.4 | 4.9 | ABSENT | 4.6 | ABSENT | 3.9 |

TABLE 5

| Ni-BASED HEAT-RESISTANT ALLOY | | REMARK | MC TYPE CARBIDE AND $M_6C$ TYPE CARBIDE UNIFORMLY DISPERSED IN γ PHASE MATRIX: AVERAGE GRAIN DIAMETER (μm) | MC TYPE CARBIDE AND $M_6C$ TYPE CARBIDE UNIFORMLY DISPERSED IN γ PHASE MATRIX: AREA RATIO (%) | BENDING TEST: ABSENCE OR EXISTENCE OF CRACKING | BENDING TEST: SURFACE ROUGHNESS (Ra) | HOLE EXPANSION TEST: ABSENCE OR EXISTENCE OF CRACKING | HOLE EXPANSION TEST: SURFACE ROUGHNESS (Ra) |
|---|---|---|---|---|---|---|---|---|
| INVENTIVE | 16 | CONTINUED | 1.5 | 7.4 | ABSENT | 5.2 | ABSENT | 4.1 |
| | 17 | FROM | 1.5 | 8.2 | ABSENT | 5.1 | ABSENT | 4.7 |
| | 18 | TABLE 2 | 1.6 | 9.2 | ABSENT | 4.8 | ABSENT | 4.0 |
| | 19 | | 1.4 | 6.4 | ABSENT | 5.5 | ABSENT | 4.4 |
| | 20 | | 1.4 | 6.5 | ABSENT | 5.5 | ABSENT | 4.6 |
| | 21 | | 1.5 | 8.0 | ABSENT | 5.3 | ABSENT | 4.4 |
| | 22 | | 1.3 | 4.8 | ABSENT | 5.3 | ABSENT | 4.2 |
| | 23 | | 1.5 | 7.3 | ABSENT | 5.0 | ABSENT | 4.2 |
| | 24 | | 1.4 | 6.4 | ABSENT | 4.8 | ABSENT | 3.8 |
| | 25 | | 1.4 | 6.4 | ABSENT | 5.4 | ABSENT | 4.6 |
| | 26 | | 1.5 | 7.3 | ABSENT | 5.0 | ABSENT | 4.2 |
| COMPARATIVE | 1 | | 1.4 | 6.8 | EXISTENT | — | EXISTENT | — |
| | 2 | | 1.6 | 2.4 | ABSENT | 10.8 | ABSENT | 8.9 |
| | 3 | | 1.4 | 6.2 | EXISTENT | — | EXISTENT | — |
| | 4 | | 1.5 | 3.3 | ABSENT | 7.0 | ABSENT | 5.5 |

TABLE 6

| Ni-BASED HEAT-RESISTANT ALLOY | | REMARK | MC TYPE CARBIDE AND $M_6C$ TYPE CARBIDE UNIFORMLY DISPERSED IN γ PHASE MATRIX: AVERAGE GRAIN DIAMETER (μm) | MC TYPE CARBIDE AND $M_6C$ TYPE CARBIDE UNIFORMLY DISPERSED IN γ PHASE MATRIX: AREA RATIO (%) | BENDING TEST: ABSENCE OR EXISTENCE OF CRACKING | BENDING TEST: SURFACE ROUGHNESS (Ra) | HOLE EXPANSION TEST: ABSENCE OR EXISTENCE OF CRACKING | HOLE EXPANSION TEST: SURFACE ROUGHNESS (Ra) |
|---|---|---|---|---|---|---|---|---|
| COMPARTIVE | 5 | ED | 1.7 | 11.2 | ABSENT | 5.9 | ABSENT | 4.9 |
| | 6 | FROM | 1.1 | 2.3 | ABSENT | 12.9 | ABSENT | 10.3 |

TABLE 6-continued

| Ni-BASED HEAT-RESISTANT ALLOY | REMARK | MC TYPE CARBIDE AND $M_6C$ TYPE CARBIDE UNIFORMLY DISPERSED IN γ PHASE MATRIX | | BENDING TEST | | HOLE EXPANSION TEST | |
|---|---|---|---|---|---|---|---|
| | | AVERAGE GRAIN DIAMETER (μm) | AREA RATIO (%) | ABSENCE OR EXISTENCE OF CRACKING | SURFACE ROUGHNESS (Ra) | ABSENCE OR EXISTENCE OF CRACKING | SURFACE ROUGHNESS (Ra) |
| 7 | | 1.7 | 12.9 | ABSENT | 5.8 | ABSENT | 5.0 |
| 8 | | 1.0 | 1.8 | ABSENT | 14.0 | ABSENT | 11.6 |
| 9 | | 1.7 | 11.1 | EXISTENT | — | EXISTENT | — |
| 10 | | 1.2 | 3.0 | ABSENT | 9.8 | ABSENT | 7.8 |
| 11 | | 1.6 | 10.2 | EXISTENT | — | EXISTENT | — |
| 12 | | 1.3 | 4.0 | ABSENT | 6.4 | ABSENT | 5.3 |
| 13 | | 1.7 | 11.8 | ABSENT | 5.2 | EXISTEBT | — |
| 14 | | 1.0 | 1.8 | ABSENT | 13.0 | ABSENT | 11.0 |
| 15 | | 1.7 | 13.7 | ABSENT | 5.1 | ABSENT | 4.5 |
| 16 | | 0.8 | 1.5 | ABSENT | 15.6 | ABSENT | 13.1 |
| 17 | | 4.5* | 8.4 | EXISTENT | — | EXISTENT | — |
| 18 | | 1.6 | 16.5* | EXISTENT | — | EXISTENT | — |
| CONVENTIONAL | | 1.4 | 5.5 | ABSENT | 4.5 | ABSENT | 3.8 |

*MARK DENOTES A VALUE OUTSIDE THE RANGE OF THE PRESENT INVENTION.

From the results shown in Tables 1 to 6, it is understood that each of the solution-treated plates made of Inventive Ni-based heat resistant alloys 1 to 26 generates lesser number of cracking in the time of working, has a small surface roughness, and excellent in workability compared to solution-treated plates made of Comparative Ni-based heat resistant alloys 1 to 18, and Conventional Ni-base heat resistant alloys.

Example 2

B. Low Cycle Fatigue Test

The above-prepared solution-treated plates B having a thickness of 20 mm, made of Inventive Ni-base heat resistant alloys 1 to 26, Comparative Ni-base heat resistant alloys 1 to 18, and a Conventional Ni-based heat resistant alloy were subjected to aging by retaining each of the plates at 850° C. for 24 hours, subsequently air-cooling the plate, further retaining the plate at 760° C. for 16 hours, and air-cooling the plate.

From the thus obtained aging-treated plates B having a thickness of 20 mm, round bar specimens were obtained. Each specimen had a diameter of parallel portion: 8 mm and a length of parallel portion: 110 mm. The specimens were subjected to a low cycle fatigue test by heating each specimen at a temperature of 700° C. and repeatedly applying tension and compression of 1.2% in strain range to the specimen as shown in FIG. 1. The number of cycles to reduce the measured load to 75% (25% reduction) of the primary load was examined for each specimen. The results are shown in Tables 7 to 9.

D. Creep Fatigue Test

Figure 2:
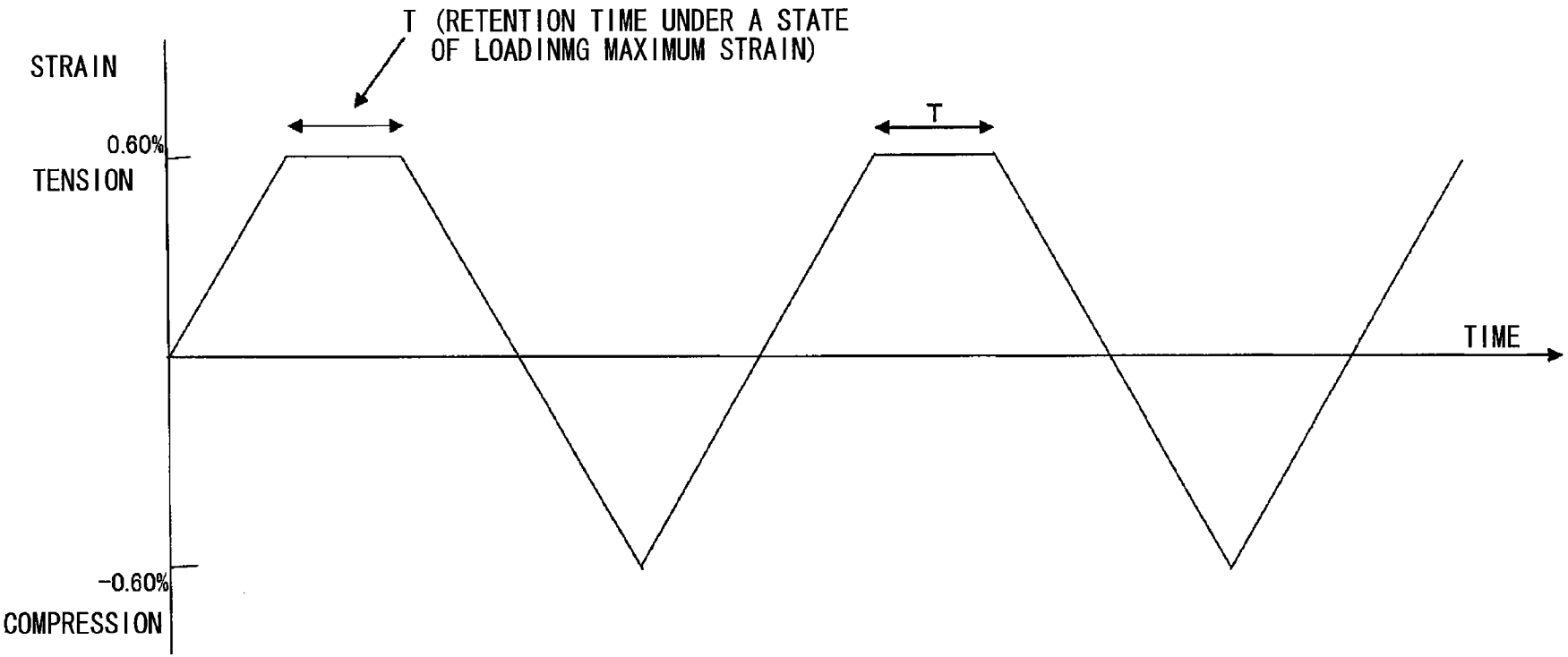
FIG. 2 is a drawing for explaining a wave-form in the creep fatigue test.

From the above-prepared aging-treated plates B having a thickness of 20 mm, round bar specimens were obtained. Each specimen had a diameter of parallel portion: 8 mm and a length of parallel portion: 110 mm. After heating the specimens at a temperature of 700° C., each specimen was subjected to a creep fatigue test by applying repeated tension and compression of 1.2% in strain range to the specimen, where, as shown in FIG. 2, the specimen was maintained at a maximum-strained state for a retention time T of 10 minutes only when a tension was applied to the specimen, and the number of cycles at which the measured load was reduced to 75% (25% reduction) of the primary load was examined. The results are shown in Tables 7 to 9.

E. Creep Fatigue Test

From the above-prepared aging-treated plates B having a thickness of 20 mm, round bar specimens were obtained. Each specimen had a diameter of parallel portion: 8 mm and a length of parallel portion: 110 mm. After heating the specimens at a temperature of 700° C., each specimen was subjected to a creep fatigue test by applying repeated tension and compression of 1.2% in strain range to the specimen, where, as shown in FIG. 2, the specimen was maintained at a maximum-strained state for a retention time T of 60 minutes only when a tension was applied to the specimen, and a number of cycle at which measured load was reduced to 75% (25% reduction) of the primary load was examined. The results are shown in Tables 7 to 9.

F. Creep Rupture Test

From the above-prepared aging-treated plates A having a thickness of 5 mm, round bar specimens were obtained. Each specimen had a diameter of parallel portion: 4 mm and a length of parallel portion: 26 mm. Each specimen was heated at 750° C. and was subjected to creep rupture test under a stress of 353 MPa, and rupture time and fracture elongation were measured. The results are shown in Tables 7-9.

G. High Temperature Tensile Test

From the above-prepared aging-treated plates A having a thickness of 5 mm, round bar specimens were obtained. Each specimen had a diameter of parallel portion: 4 mm and a length of parallel portion: 26 mm. Each specimen was subjected to high-temperature tensile tests at 700° C. and 900° C., and 0.2% proof stress, tensile strength, and fracture elongation were measured. The results of measurement are shown in Tables 10 to 12.

TABLE 7

| Ni-BASED HEAT-RESISTANT ALLOY | REMARK | LOW CYCLE FATIGUE TEST NUMBER OF CYCLE (Cycle) | CREEP FATIGUE TEST 1 NUMBER OF CYCLE (Cycle) | CREEP FATIGUE TEST 2 NUMBER OF CYCLE (Cycle) | CREEP-RUPTURE TEST RUPTURE TIME (h) | CREEP-RUPTURE TEST FRACTURE ELONGATION (%) |
|---|---|---|---|---|---|---|
| INVENTIVE 1 | CONTINUED | 825 | 722 | 500 | 440.9 | 45.7 |
| 2 | FROM | 899 | 791 | 502 | 488.3 | 35.9 |
| 3 | TABLE 4 | 917 | 793 | 504 | 497.7 | 35.5 |
| 4 | | 964 | 836 | 529 | 545.9 | 33.2 |
| 5 | | 883 | 781 | 497 | 465.3 | 37.0 |
| 6 | | 851 | 691 | 444 | 508.2 | 35.0 |
| 7 | | 802 | 561 | 394 | 576.5 | 31.8 |
| 8 | | 866 | 673 | 434 | 563.5 | 32.4 |
| 9 | | 883 | 744 | 475 | 510.2 | 34.9 |
| 10 | | 867 | 692 | 445 | 540.2 | 33.5 |
| 11 | | 851 | 706 | 453 | 489.9 | 35.9 |
| 12 | | 718 | 511 | 369 | 628.8 | 29.4 |
| 13 | | 762 | 560 | 393 | 623.1 | 29.6 |
| 14 | | 748 | 581 | 406 | 529.0 | 34.0 |
| 15 | | 707 | 517 | 367 | 550.6 | 24.4 |

TABLE 8

| Ni-BASED HEAT-RESISTANT ALLOY | REMARK | LOW CYCLE FATIGUE TEST NUMBER OF CYCLE (Cycle) | CREEP FATIGUE TEST 1 NUMBER OF CYCLE (Cycle) | CREEP FATIGUE TEST 2 NUMBER OF CYCLE (Cycle) | CREEP-RUPTURE TEST RUPTURE TIME (h) | CREEP-RUPTURE TEST FRACTURE ELONGATION (%) |
|---|---|---|---|---|---|---|
| INVENTIVE 16 | CONTINUED | 883 | 729 | 466 | 528.9 | 34.0 |
| 17 | FROM | 899 | 764 | 487 | 519.5 | 34.5 |
| 18 | TABLE 5 | 897 | 685 | 433 | 657.0 | 28.0 |
| 19 | | 864 | 777 | 521 | 373.1 | 41.3 |
| 20 | | 863 | 602 | 392 | 649.5 | 28.4 |
| 21 | | 899 | 805 | 511 | 470.7 | 36.8 |
| 22 | | 834 | 611 | 397 | 576.1 | 31.8 |
| 23 | | 883 | 725 | 464 | 533.1 | 33.8 |
| 24 | | 867 | 730 | 467 | 493.9 | 35.7 |
| 25 | | 867 | 764 | 487 | 450.6 | 37.7 |
| 26 | | 879 | 634 | 410 | 642.3 | 28.7 |
| COMPAERATIVE 1 | | 747 | 250 | 164 | 1048.9 | 13.7 |
| 2 | | 617 | 301 | 214 | 109.7 | 55.8 |
| 3 | | 825 | 204 | 137 | 1193.4 | 6.9 |
| 4 | | 614 | 304 | 216 | 69.0 | 57.7 |

TABLE 9

| Ni-BASED HEAT-RESISTANT ALLOY | REMARK | LOW CYCLE FATIGUE TEST NUMBER OF CYCLE (Cycle) | CREEP FATIGUE TEST 1 NUMBER OF CYCLE (Cycle) | CREEP FATIGUE TEST 2 NUMBER OF CYCLE (Cycle) | CREEP-RUPTURE TEST RUPTURE TIME (h) | CREEP-RUPTURE TEST FRACTURE ELONGATION (%) |
|---|---|---|---|---|---|---|
| COMPARATIVE 5 | DFRO | 948 | 360 | 229 | 1009.9 | 11.5 |
| 6 | | 740 | 369 | 230 | 143.6 | 54.2 |
| 7 | | 987 | 369 | 234 | 1047.6 | 13.7 |
| 8 | | 700 | 318 | 224 | 89.3 | 56.8 |
| 9 | | 1008 | 271 | 176 | 1208.5 | 6.2 |
| 10 | | 695 | 324 | 208 | 20.2 | 60.0 |
| 11 | | 972 | 294 | 190 | 1154.7 | 8.7 |
| 12 | | 721 | 368 | 233 | 36.3 | 59.3 |
| 13 | | 942 | 334 | 214 | 861.5 | 18.5 |
| 14 | | 740 | 369 | 224 | 189.5 | 52.1 |
| 15 | | 980 | 363 | 230 | 930.2 | 15.2 |
| 16 | | 665 | 265 | 173 | 51.8 | 58.5 |
| 17 | | 901 | 335 | 214 | 1008.8 | 11.6 |
| 18 | | 919 | 332 | 212 | 935.7 | 15.0 |
| CONVENTIONAL | | 515 | 360 | 211 | 1.9 | 116.9 |

TABLE 10

| Ni-BASED HEAT-RESISTANT ALLOY | | REMARK | HIGH-TEMPERATURE TENSILE TEST AT 700° C. 0.2% PROOF STRESS (MPa) | TENSILE STRENGTH (MPa) | FRACTURE ELONGATION (%) | HIGH-TEMPERATURE TENSILE TEST AT 900° C. 0.2% PROOF STRESS (MPa) | TENSILE STRENGTH (MPa) | FRACTURE ELONGATION (%) |
|---|---|---|---|---|---|---|---|---|
| INVENTIVE | 1 | CONTINUED | 738 | 1071 | 41.9 | 284 | 405 | 51.3 |
| | 2 | FROM | 742 | 1074 | 36.3 | 270 | 401 | 54.9 |
| | 3 | TABLE 7 | 775 | 1102 | 36.8 | 269 | 405 | 52.5 |
| | 4 | | 826 | 1145 | 36.8 | 273 | 414 | 46.3 |
| | 5 | | 739 | 1069 | 36.5 | 266 | 396 | 57.6 |
| | 6 | | 711 | 1043 | 34.6 | 278 | 398 | 56.0 |
| | 7 | | 667 | 1003 | 31.6 | 294 | 398 | 53.6 |
| | 8 | | 731 | 1058 | 33.5 | 286 | 404 | 51.0 |
| | 9 | | 743 | 1061 | 35.3 | 276 | 402 | 54.1 |
| | 10 | | 729 | 1058 | 34.1 | 283 | 403 | 52.7 |
| | 11 | | 710 | 1043 | 35.0 | 275 | 396 | 57.4 |
| | 12 | | 700 | 1031 | 31.0 | 298 | 403 | 48.3 |
| | 13 | | 749 | 1077 | 32.7 | 291 | 410 | 45.2 |
| | 14 | | 729 | 1058 | 34.4 | 281 | 402 | 53.5 |
| | 15 | | 736 | 1062 | 33.8 | 301 | 409 | 46.9 |

TABLE 11

| Ni-BASED HEAT-RESISTANT ALLOY | | REMARK | HIGH-TEMPERATURE TENSILE TEST AT 700° C. 0.2% PROOF STRESS (MPa) | TENSILE STRENGTH (MPa) | FRACTURE ELONGATION (%) | HIGH-TEMPERATURE TENSILE TEST AT 900° C. 0.2% PROOF STRESS (MPa) | TENSILE STRENGTH (MPa) | FRACTURE ELONGATION (%) |
|---|---|---|---|---|---|---|---|---|
| INVENTIVE | 16 | CONTINUED | 745 | 1062 | 34.8 | 279 | 403 | 52.7 |
| | 17 | FROM | 745 | 1075 | 35.5 | 276 | 404 | 52.5 |
| | 18 | TABLE 8 | 765 | 1091 | 32.3 | 293 | 412 | 42.2 |
| | 19 | | 708 | 1049 | 38.5 | 242 | 375 | 66.1 |
| | 20 | | 732 | 1059 | 31.3 | 297 | 407 | 45.3 |
| | 21 | | 741 | 1073 | 36.7 | 266 | 399 | 56.3 |
| | 22 | | 699 | 1031 | 32.4 | 291 | 401 | 51.9 |
| | 23 | | 745 | 1062 | 34.7 | 280 | 404 | 52.4 |
| | 24 | | 726 | 1057 | 35.3 | 274 | 398 | 56.2 |
| | 25 | | 721 | 1055 | 36.5 | 264 | 392 | 59.6 |
| | 26 | | 748 | 1063 | 31.8 | 295 | 409 | 44.9 |
| COMPARARIVE | 1 | | 715 | 1082 | 18.8 | 322 | 473 | 26.9 |
| | 2 | | 509 | 917 | 43.0 | 208 | 283 | 80.8 |
| | 3 | | 781 | 1169 | 16.2 | 337 | 572 | 21.0 |
| | 4 | | 494 | 912 | 44.5 | 200 | 269 | 84.7 |

TABLE 12

| Ni-BASED HEAT-RESISTANT ALLOY | | REMARK | HIGH-TEMPERATURE TENSILE TEST AT 700° C. 0.2% PROOF STRESS (MPa) | TENSILE STRENGTH (MPa) | FRACTURE ELONGATION (%) | HIGH-TEMPERATURE TENSILE TEST AT 900° C. 0.2% PROOF STRESS (MPa) | TENSILE STRENGTH (MPa) | FRACTURE ELONGATION (%) |
|---|---|---|---|---|---|---|---|---|
| COMPARATIVE | 5 | CONTINUED | 792 | 1143 | 19.8 | 311 | 465 | 23.7 |
| | 6 | FROM | 532 | 931 | 42.1 | 214 | 293 | 77.0 |
| | 7 | TABLE 9 | 826 | 1179 | 19.6 | 311 | 484 | 20.9 |
| | 8 | | 478 | 894 | 43.2 | 205 | 275 | 84.0 |
| | 9 | | 816 | 1202 | 16.6 | 337 | 589 | 19.1 |
| | 10 | | 453 | 886 | 45.8 | 190 | 250 | 90.5 |
| | 11 | | 790 | 1168 | 17.6 | 329 | 543 | 20.9 |
| | 12 | | 483 | 909 | 45.8 | 193 | 257 | 87.7 |
| | 13 | | 808 | 1139 | 19.1 | 301 | 430 | 28.6 |
| | 14 | | 543 | 934 | 40.5 | 222 | 304 | 72.8 |
| | 15 | | 839 | 1173 | 19.5 | 302 | 446 | 24.0 |
| | 16 | | 432 | 862 | 43.8 | 198 | 261 | 89.3 |

TABLE 12-continued

| Ni-BASED HEAT-RESISTANT ALLOY | REMARK | HIGH-TEMPERATURE TENSILE TEST AT 700° C. 0.2% PROOF STRESS (MPa) | TENSILE STRENGTH (MPa) | FRACTURE ELONGATION (%) | HIGH-TEMPERATURE TENSILE TEST AT 900° C. 0.2% PROOF STRESS (MPa) | TENSILE STRENGTH (MPa) | FRACTURE ELONGATION (%) |
|---|---|---|---|---|---|---|---|
| 17 | | 744 | 1102 | 19.6 | 316 | 460 | 26.4 |
| 18 | | 775 | 1118 | 19.3 | 308 | 440 | 27.2 |
| CONVENTIONAL | | 234 | 584 | 98.8 | 182 | 248 | 130.0 |

From the results shown in Tables 1 to 3 and Tables 7 to 12, it can be understood that each of Inventive Ni-based heat resistant alloys 1 to 26 which have been aging treated after the solution treatment shows excellent value in a low cycle fatigue test, a creep fatigue test, a creep-rupture test and high-temperature tensile test.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

INDUSTRIAL APPLICABILITY

A Ni-based heat resistant alloy of the present invention has excellent high-temperature strength, such as high-temperature tensile strength, creep fatigue strength, low-cycle fatigue strength, and thermal fatigue strength, and further excellent in high-temperature corrosion resistance such as high-temperature oxidation resistance and high-temperature sulfidization resistance. Therefore, where the alloy is used for various parts of gas-turbine engine, especially a liner or a transition piece of a gas turbine, the alloy can exhibit excellent properties for a long period of time. In addition, since the Ni-based heat resistant alloy of the present invention is excellent in workability, it can be subjected to a shaping and working at high precision even when the alloy is used for producing a parts, for example, a liner and a transition piece or the like of a gas-turbine engine having a complicated structure.

The invention claimed is:

1. A Ni-based heat resistant alloy for a gas turbine combustor, having a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%; Fe: 7.0% or less, B: 0.001 to 0.020%, and C: 0.03 to 0.15%, with a balance being Ni and unavoidable impurities, wherein contents of S and P contained in the unavoidable impurities are controlled to be in mass %, S: 0.015% or less, and P: 0.015% or less, wherein the alloy has a texture in which $M_6C$ carbide and MC carbide are uniformly dispersed in γ phase matrix, wherein the M in the $M_6C$ carbide has a composition containing, in mass %, Ni: 12.0 to 45.0%, Cr: 9.0 to 22.0%, Co: 0.5 to 13.5%, W: 2.0 to 24.0%, Al: 5.0% or less, and Ti: 0.5 to 6.0%, with a balance being Mo and unavoidable impurities, and wherein the M in the MC carbide has a composition containing, in mass %, Ni: 7.0% or less, Cr: 6.0% or less, Co: 12.0% or less, Mo: 57.0% or less, W: 15% or less, and Al: 6.0% or less, with a balance being Ti and unavoidable impurities.

2. The Ni-based heat resistant alloy for a gas-turbine combustor according to claim 1, wherein the $M_6C$ carbide and the MC carbide each have an average grain diameter of 0.3 to 4.0 μm, and the $M_6C$ carbide and the MC carbide are uniformly dispersed in the matrix at a total proportion of 0.5 to 16.0 area %.

3. The member for a liner of a gas-turbine combustor, made of a Ni-based heat resistant alloy according to claim 1.

4. The member for a transition piece of a gas-turbine combustor, made of a Ni-based heat resistant alloy according to claim 1.

5. The liner of a gas turbine combustor, being constituted of a Ni-based heat resistant alloy according to claim 1.

6. The transition piece of a gas turbine combustor, being constituted of a Ni-based heat resistant alloy according to claim 1.

7. The Ni-based heat resistant alloy for a gas-turbine combustor according to claim 1, wherein aging treatment is performed on the alloy by retaining the alloy at a temperature of 650 to 900° C. for 12 to 48 hours.

8. A Ni-based heat resistant alloy for a gas turbine combustor, having a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%; Fe: 7.0% or less, Nb: 0.1 to 1.0%, B: 0.001 to 0.020%, and C: 0.03 to 0.15%, with a balance being Ni and unavoidable impurities, wherein contents of S and P contained in the unavoidable impurities are controlled to be, in mass %, S: 0.015% or less, and P: 0.015% or less, and wherein the alloy has a texture in which $M_6C$ carbide and MC carbide are uniformly dispersed in γ phase matrix, wherein the M in the $M_6C$ carbide has a composition containing, in mass %, Ni: 12.0 to 45.0%, Cr: 9.0 to 22.0%, Co: 0.5 to 13.5%, W: 2.0 to 24.0%, Al: 5.0% or less, Ti: 0.5 to 6.0%, and Nb: 1.0% or less, with a balance being Mo and unavoidable impurities, and wherein the M in the MC carbide has a composition containing, in mass %, Ni: 7.0% or less, Cr: 6.0% or less, Co: 12.0% or less, Mo: 57.0% or less, W: 15% or less, Nb: 65% or less, and Al: 6.0% or less, with a balance being Ti and unavoidable impurities.

9. The Ni-based heat resistant alloy for a gas-turbine combustor according to claim 8, wherein the $M_6C$ carbide and the MC carbide each have an average grain diameter of 0.3 to 4.0 μm, and the $M_6C$ carbide and the MC carbide are uniformly dispersed in the matrix at a total proportion of 0.5 to 16.0 area %.

10. The member for a liner of a gas-turbine combustor, made of a Ni-based heat resistant alloy according to claim 8.

11. The member for a transition piece of a gas-turbine combustor, made of a Ni-based heat resistant alloy according to claim 8.

12. The liner of a gas turbine combustor, being constituted of a Ni-based heat resistant alloy according to claim 8.

13. The transition piece of a gas turbine combustor, being constituted of a Ni-based heat resistant alloy according to claim 8.

14. The Ni-based heat resistant alloy for a gas-turbine combustor according to claim 8, wherein aging treatment is performed on the alloy by retaining the alloy at a temperature of 650 to 900° C. for 12 to 48 hours.

15. A Ni-based heat resistant alloy for a gas-turbine combustor, having a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%; Fe: 7.0% or less, B: 0.001 to 0.020%, and C: 0.03 to 0.15%, with a balance being Ni and unavoidable impurities, wherein contents of S and P contained in the unavoidable impurities are controlled to be, in mass %, S: 0.015% or less; P: 0.015% or less, wherein the alloy has a texture in which $M_6C$ carbide and MC carbide are uniformly dispersed in matrix comprising a mixed phase of γphase and γ' phase, wherein the M in the $M_6C$ carbide has a composition containing, in mass %, Ni: 12.0 to 45.0%, Cr: 9.0 to 22.0%, Co: 0.5 to 13.5%, W: 2.0 to 24.0%, Al: 5.0% or less, and Ti: 0.5 to 6.0%, with a balance being Mo and unavoidable impurities, and wherein the M in the MC carbide has a composition containing, in mass %, Ni: 7.0% or less, Cr: 6.0% or less, Co: 12.0% or less, Mo: 57.0% or less, W: 15% or less, and Al: 6.0% or less, with a balance being Ti and unavoidable impurities.

16. The Ni-based heat resistant alloy for a gas-turbine combustor according to claim 15, wherein the $M_6C$ carbide and the MC carbide each have an average grain diameter of 0.3 to 4.0 μm, and the $M_6C$ carbide and the MC carbide are uniformly dispersed in the matrix at a total proportion of 0.5 to 16.0 area %.

17. The member for a liner of a gas-turbine combustor, made of a Ni-based heat resistant alloy according to claim 15.

18. The member for a transition piece of a gas-turbine combustor, made of a Ni-based heat resistant alloy according to claim 15.

19. The liner of a gas turbine combustor, being constituted of a Ni-based heat resistant alloy according to claim 15.

20. The transition piece of a gas turbine combustor, being constituted of a Ni-based heat resistant alloy according to claim 15.

21. The Ni-based heat resistant alloy for a gas-turbine combustor according to claim 15, wherein aging treatment is performed on the alloy by retaining the alloy at a temperature of 650 to 900° C. for 12 to 48 hours.

22. A Ni-based heat resistant alloy for a gas-turbine combustor, having a composition containing, in mass %, Cr: 14.0 to 21.5%, Co: 6.5 to 14.5%, Mo: 6.5 to 10.0%, W: 1.5 to 3.5%, Al: 1.2 to 2.4%, Ti: 1.1 to 2.1%; Fe: 7.0% or less, Nb: 0.1 to 1.0%, B: 0.001 to 0.020%, and C: 0.03 to 0.15%, with a balance being Ni and unavoidable impurities, wherein contents of S and P contained in the unavoidable impurities are controlled, in mass %, S: 0.015% or less; P: 0.015% or less, wherein the alloy has a texture in which $M_6C$ carbide and MC carbide are uniformly dispersed in matrix comprising a mixed phase of γ phase and γ' phase, wherein the M in the $M_6C$ carbide has a composition containing, in mass %, Ni: 12.0 to 45.0%, Cr: 9.0 to 22.0%, Co: 0.5 to 13.5%, W: 2.0 to 24.0%, Al: 5.0% or less, Ti: 0.5 to 6.0%, and Nb: 1.0% or less, with a balance being Mo and unavoidable impurities, and wherein the M in the MC carbide has a composition containing, in mass %, Ni: 7.0% or less, Cr: 6.0% or less, Co: 12.0% or less, Mo: 57.0% or less, W: 15% or less, Nb: 65% or less, and Al: 6.0% or less, with a balance being Ti and unavoidable impurities.

23. The Ni-based heat resistant alloy for a gas-turbine combustor according to claim 22, wherein the $M_6C$ carbide and the MC carbide each have an average grain diameter of 0.3 to 4.0 μm, and the $M_6C$ carbide and the MC carbide are uniformly dispersed in the matrix at a total proportion of 0.5 to 16.0 area %.

24. The member for a liner of a gas-turbine combustor, made of a Ni-based heat resistant alloy according to claim 22.

25. The member for a transition piece of a gas-turbine combustor, made of a Ni-based heat resistant alloy according to claim 22.

26. The liner of a gas turbine combustor, being constituted of a Ni-based heat resistant alloy according to claim 22.

27. The transition piece of a gas turbine combustor, being constituted of a Ni-based heat resistant alloy according to claim 22.

28. The Ni-based heat resistant alloy for a gas-turbine combustor according to claim 22, wherein aging treatment is performed on the alloy by retaining the alloy at a temperature of 650 to 900° C. for 12 to 48 hours.

* * * * *